US007223142B1

(12) United States Patent
McDonough

(10) Patent No.: US 7,223,142 B1
(45) Date of Patent: May 29, 2007

(54) MARINE RESCUE ASSEMBLY AND A METHOD FOR RESCUING AN INDIVIDUAL

(76) Inventor: Kevin McDonough, 26140 Pine St., Beaver Island, MI (US) 49782

( * ) Notice: Subject to any disclaimer, the term of this patent is extended or adjusted under 35 U.S.C. 154(b) by 0 days.

(21) Appl. No.: 11/220,989

(22) Filed: Sep. 7, 2005

(51) Int. Cl.
*B63C 9/00* (2006.01)

(52) U.S. Cl. ..... 441/80; 441/83

(58) Field of Classification Search ..... 441/80, 441/83, 84, 86, 87; 114/44, 51, 368
See application file for complete search history.

(56) References Cited

U.S. PATENT DOCUMENTS

| | | | | |
|---|---|---|---|---|
| 581,197 | A | 4/1897 | Cook | |
| 598,294 | A | 2/1898 | Robbns | |
| 636,689 | A | 11/1899 | Nochols et al. | |
| 773,000 | A | 10/1904 | Canfield | |
| 889,699 | A | 6/1908 | Lipscomb | |
| 1,128,656 | A * | 2/1915 | Broady | 114/368 |
| 1,619,000 | A * | 3/1927 | Sieurin | 114/368 |
| 2,545,452 | A | 3/1951 | Fletcher | |
| 2,700,781 | A | 2/1955 | Smith | |
| 2,817,860 | A | 12/1957 | Fritz | |
| 3,036,315 | A | 5/1962 | Karnow | |
| 3,228,044 | A | 1/1966 | Mattenson | |
| 3,866,966 | A | 2/1975 | Skinner, II | |
| 4,583,617 | A | 4/1986 | Berger | |
| 4,592,581 | A | 6/1986 | Howard et al. | |
| 4,631,038 | A * | 12/1986 | Ritter et al. | 441/80 |
| 4,678,446 | A * | 7/1987 | Dahan | 441/80 |
| 4,850,631 | A | 7/1989 | Dotsko | |
| 4,861,299 | A * | 8/1989 | Ueberschaer | 441/80 |
| 5,080,682 | A | 1/1992 | Schectman | |
| 5,200,679 | A | 4/1993 | Graham | |
| 5,320,566 | A * | 6/1994 | Low, Jr. | 441/80 |
| 5,356,187 | A | 10/1994 | McCarthy et al. | |
| 6,953,374 | B1 * | 10/2005 | Connolly | 441/80 |

FOREIGN PATENT DOCUMENTS

| | | | |
|---|---|---|---|
| DE | 3537387 A1 * | 4/1987 | |
| WO | WO 00/78397 | 12/2000 | |

* cited by examiner

*Primary Examiner*—Lars A. Olson
(74) *Attorney, Agent, or Firm*—Law Offices of John Chupa & and Associates, P.C.

(57) ABSTRACT

A marine assembly which obviates the need for a rescuer to enter the water 500 to rescue an individual 400, and which includes a containment portion 14 which is generally semi-cylindrical in cross-section and which has a first firm portion 12 and a second substantially pliable netting portion 68, and which is selectively and pivotally articulable from a first closed position to a second open position, and a hoist assembly 100 which is operatively coupled to said containment portion 14, and a method of rescuing an individual 400 from a body of water 8.

18 Claims, 3 Drawing Sheets

MARINE RESCUE ASSEMBLY AND A METHOD FOR RESCUING AN INDIVIDUAL

FIELD OF THE INVENTION

The present invention generally relates to a marine rescue assembly, and more particularly, by way of example and without limitation, to a marine rescue assembly which has a generally semi-cylindrical containment portion including a first firm portion and a second pliable netting portion, which may be selectively and accurately deployed within water and which is effective to selectively rescue an individual, and to a new and novel method for efficiently rescuing an individual within a marine environment.

BACKGROUND OF THE INVENTION

Marine rescue devices and/or assemblies are used to selectively recover and/or rescue individuals who are stranded in (i.e., who are "adrift" and/or otherwise endangered or inconvenienced by being in) a body of water (e.g., an ocean, a lake, or another type of marine environment), and to selectively remove these individuals from the body of water and onto a ship, helicopter and/or other selectively movable assembly.

Prior and/or current marine rescue devices and/or assemblies are typically and selectively lowered into the water by the use a pulley device (e.g., a crank and/or winch mechanism and a cable assembly which cooperatively and selectively raise and lower the marine rescue device into the body of water). These devices typically include a containment and/or rescue/containment portion which, as previously indicated, is typically lowered into the water, whereupon the individual to be rescued must actively climb and/or maneuver into the containment portion of the assembly and is then removed from the water.

These foregoing devices, while sometimes effectively allowing an individual to be rescued, suffer from some drawbacks. For example and without limitation, the foregoing containment portion of each of the devices typically is wholly comprised of a soft and pliable "net" and/or "mesh" portion which is designed to hold and/or support an individual being rescued. This netting portion often becomes tangled (i.e., wrapped) around the individual or "around itself" and is very difficult to be accurately positioned within the water. Hence, these rescue devices and assemblies are oftentimes ineffective and/or difficult to operate and do not have a high probability of successful deployment.

Further, these prior and/or current rescue devices and/or assemblies are typically adapted so that an individual must "climb into" (i.e., actively move towards, onto, and/or otherwise into contact with) the respective containment portion since the soft and pliable netting portion is not easily maneuverable within the water and is not adapted to readily "scoop up" the individual to be rescued. In cases where there are strong winds and/or high waves and/or other "environmental-type" effects, it can be difficult or impossible for the individual to "climb into" the rescue assembly (or even ensure that these respective containment portions come close to the individual to be rescued). Additionally, if the individual to be rescued is unconscious or otherwise unresponsive, it can also be difficult or impossible to collect the individual with the rescue assembly portion.

There is therefore a need for a new and novel marine rescue device and a method for rescuing an individual, which allows a rescuer or rescuers to quickly, safely and efficiently collect a conscious and/or unconscious individual from a body of water, and which overcomes at least some of the drawback associated with prior and/or current marine rescue devices.

SUMMARY OF THE INVENTION

It is a first non-limiting object of the present invention to provide a marine rescue assembly which overcomes some or all of the drawbacks associated with prior and/or current marine rescue assemblies.

It is a second non-limiting object of the present invention to provide a marine rescue assembly which overcomes some or all of the drawbacks associated with prior and/or current marine rescue assemblies, and which allows a stranded individual to be rescued from a body of water.

It is a third non-limiting object of the present invention to provide a marine rescue assembly which overcomes some or all of the drawbacks associated with prior and/or current marine rescue assemblies, which allows a stranded individual to be rescued from a body of water, and which includes a flexible and/or deformable mesh and/or net portion which forms only a portion of a containment cavity.

It is a fourth non-limiting object of the present invention to provide a marine rescue assembly which overcomes some or all of the drawbacks associated with prior and/or current marine rescue assemblies, which allows an individual to be rescued from a body of water, which includes a flexible and/or deformable mesh and/or net portion, and which can be used to rescue an individual who is unconscious.

It is a fifth non-limiting object of the present invention to provide a marine rescue assembly which overcomes some or all of the drawbacks associated with prior and/or current marine rescue assemblies, which allows an individual to be rescued from a body of water, which includes a flexible and/or deformable mesh and/or net portion, which can be used to rescue an individual who is unconscious, and which is selectively removable and/or storable.

It is a sixth non-limiting object of the present invention to provide a method for rescuing an individual or item from a body of water in a manner which overcomes the drawbacks associated with prior and/or currently used methods and which may be selectively and relatively easily deployed in a body of water in a highly accurate manner.

According to a first non-limiting aspect of the present invention a marine rescue assembly is provided which comprises a semi-cylindrical containment portion having a first firm portion with a plurality of substantially identical stiffening ribs; and a second pliable net portion and wherein the first portion is selectively articulable with respect to the second portion.

According to a second non-limiting aspect of the present invention, a marine rescue assembly is provided which comprises a containment portion which comprises a first portion comprising first and second substantially identical and generally round firm members, which are in parallel relation to each other, and wherein said first portion further includes a first and second substantially identical and arcuate stiffening rib, each of said first and second ribs being connected to said first and second substantially identical and generally round firm members, and wherein said first portion further includes third and fourth substantially identical and arcuate stiffening ribs, and wherein each of said third and fourth stiffening ribs are coupled to and terminate within said first generally round firm member receive, along respective side portions, said second generally round firm member, and wherein each of said third and fourth stiffening ribs include respective and substantially identical flared ends having a respective connector reception portion; and a second portion comprising a third generally round and firm member which is substantially identical to and generally parallel to said first and second generally round firm members and which includes a pair of opposed end portions which are selectively and respectively received into a unique one of said reception portions, thereby allowing said second portion to be selectively articulable with respect to said first portion, and wherein said second portion includes a pliable net portion which is coupled to said second and third generally round firm members and said opposed end portions and wherein said first and second portions cooperatively form a cavity which is generally semi-cylindrical in cross-section.

According to a third non-limiting aspect of the present invention, a marine rescue assembly is provided which comprises a containment portion and a hoist assembly, and wherein said hoist assembly comprises a first vertical support member; a second horizontal support member; a winch assembly; a cable; and a storage support member.

According to a fourth non-limiting aspect of the present invention, a method for rescuing an individual is provided which comprises the steps of:

(a) forming a marine assembly which includes a hoist assembly which is operatively coupled to a containment portion having a first firm portion which includes a plurality of substantially identical stiffening ribs, and a second pliable netting portion, and wherein said containment portion is selectively and articulably movable from a first closed position to a second open position by means of a maneuvering implement, and wherein said containment portion is generally semi-cylindrical;

(b) hoisting said containment portion from a storage position;

(c) articulating said containment portion from first closed position to said second open position by means of said maneuvering implement;

(d) deploying said containment portion into an operational area;

(e) articulating said containment portion to said first closed position, thereby "scooping up" and containing an individual; and (f) hoisting said containment portion from said operational area; thereby rescuing said contained individual from said operational area.

These and other features and advantages of the present invention will become apparent upon a reading of the following detailed description of the preferred embodiment of the invention and by reference to the following drawings.

DETAILED DESCRIPTION OF THE PREFERRED EMBODIMENT OF THE INVENTION

Referring now to FIGS. 1–4, there is shown a marine rescue assembly or "mechanism" 10 which is made in accordance with the teachings of the preferred embodiment of the invention.

Figure 2:
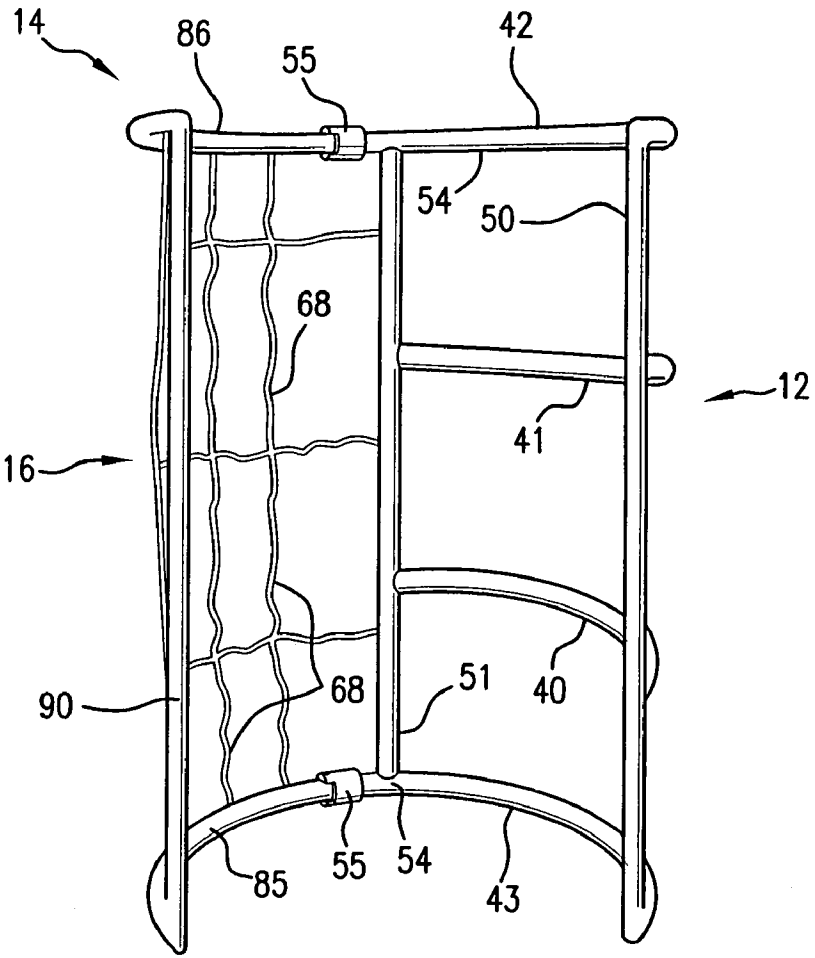
FIG. 2 is a side view of the containment portion of the rescue assembly which is shown in FIG. 1.
Figure 1:
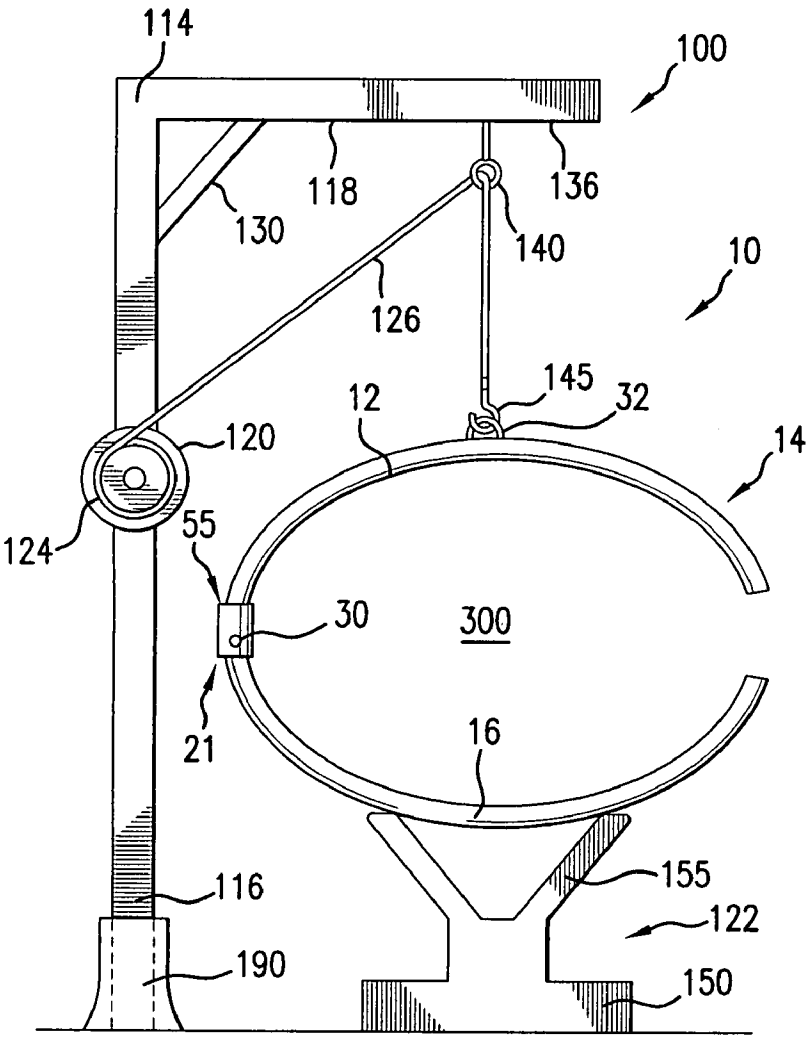
FIG. 1 is a side view of the marine rescue assembly which is made in accordance with the teachings of the preferred embodiment of the invention.
Figure 3:
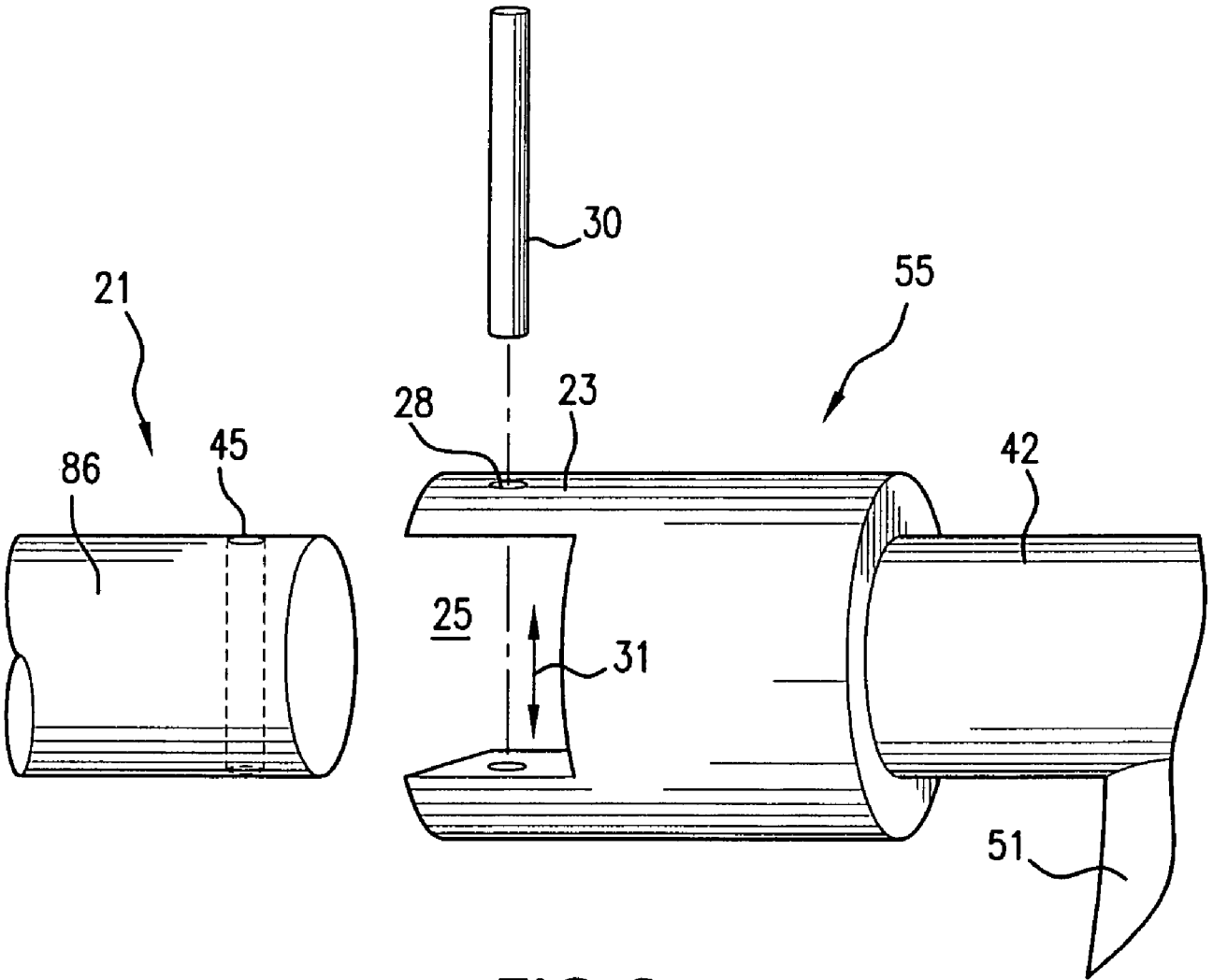
FIG. 3 is a partial side view of a portion of the containment portion which is shown in FIG. 2.

Particularly, marine assembly 10 includes a selectively deployable and selectively articulable general semi-cylindrically shaped rescue and/or "containment" portion 14 and a hoist portion 100 which is selectively coupled to the portion 14 and which as discussed below, selectively causes the portion 14 to be lowered into a marine type environment in order that a rescue may be effectuated. The rescue and/or containment portion 14 includes a first portion 12 and a second portion 16 which are operatively and pivotally coupled together (e.g., portion 12 is selectively articulable with respect to portion 14). Particularly, the rescue and/or containment portion 14 is selectively articulable from a first open position in which the two portions 12, 16 are remote from one another to a second closed position in which the two portions 12, 16 form a substantially closed cavity 300 which has a substantially C-shaped cross-sectional area and which is best shown in FIG. 1. The rescue and/or containment portion 14 further includes a pliable netting portion 68 which is selectively and operatively disposed within, around, and/or upon one of the portions 12, 16. The containment portion 14 will now be more fully described.

In one non-limiting embodiment of the invention, the first portion 12 comprises a first generally round and elongated firm member 50 and a second substantially identical round and elongated firm member 51, which are parallel in relation to each other. The members 50, 51 may be substantially identical and are each respectively and abuttingly coupled to first and second substantially identical and arcuate and firm stiffening rib members 40, 41, and are each further coupled to third and fourth substantially identical and arcuate stiffening rib members 42, 43.

In one non-limiting embodiment of the invention, each of the members 42, 43 are coupled to the first generally round firm member 50 and receive, along respective side portions 54, a unique opposed end of the second generally round firm member 51. In this non-limiting embodiment of the invention, each stiffening rib member 42, 43 further and respectively includes a end 55 which protrudes past the portion where the members 42, 43 respectively receive member 51, and each respective end 55 further includes a pair of substantially identical and generally rounded protruding flanges 23 which are parallel in relation to one another. Each pair of flanges 23 cooperatively forms a reception cavity 25 and each of the pair of flanges 23 has a circular opening 28. Each opening 28 is axially aligned and adapted to frictionally and pivotally receive a connecting member such as pin 30. In one non-limiting embodiment of the invention, the various members 50, 51, 40, 41, 42, and 43 may be integrally coupled in order to cooperatively form the portion 12.

Further, in the most preferred embodiment of the invention, a second portion 16 is operatively and pivotally coupled to the first portion 12, and is selectively articulable from a first open position in which the second portion 16 is remote from the first portion to a second position in which the second portion and the first portion form a cavity 300 which is generally semi-cylindrical in cross-section. The second portion 16 will now be more fully described. Such coupling, as in perhaps best shown in FIG. 2, occurs by the use of member portions 55.

Particularly, as shown, the second portion 16 comprises a third generally round and firm elongated member 90 which is abuttingly coupled to a pair of substantially identical arcuate end portions 85, 86. Each of the respective end portions 21 of the members 85, 86 has a respective "through hole" 45, and each such opening or "through hole" 45 is adapted to be communicatively coupled to and be axially aligned with a unique pair of openings 25 and operatively and frictionally receive a connector member such as pin 30. In this manner, each end portion 21 is selectively and articulably coupled to a unique one of the members 42, 43 and resides within a unique one of the cavities 25. Thus, the portion 16 is selectively movable and articulable in relation to the portion 12 (e.g., respectively and selectively moving in a direction perpendicular to the axis defined by respective connecting pin 30).

In the most preferred embodiment of the invention, a netting portion 68, which is substantially "grid" shaped (i.e., the netting is composed of strips which intersect at right angles to form the portion 68) and which may selectively be weighted, is coupled to the members 51, 90 and rib members 85, 86. The netting portion 68 may be formed from cloth, nylon, or substantially any other desired material and such coupling may be achieved by conventional fasteners.

It should be apparent that the cage portions 12, 16 cooperatively form a cavity 300 when the portion 16 is selectively articulated to a closed position. It should further be apparent that the previously described configuration (as shown in FIGS. 1–4) is only the most preferred embodiment of the invention, and that the rescue and/or containment portion 14 may be formed in substantially any desired shape and may be formed of steel, aluminum, plastic or plastic compounds, and/or substantially any desired material. Additionally, in one non-limiting embodiment, an "eye" member 32 is deployed and/or is formed upon the portion 14, and the eye member 32 is adapted to receive a hook member such as hook 145.

Further, as earlier indicated, the rescue assembly 10 further includes, in one non-limiting embodiment, a hoist assembly 100, which is deployed on the deck, floor, and/or other surface 200 of a "seagoing" or other type of selectively movable marine type assembly, which includes an upright support member 116 which is welded, bolted, and/or otherwise attached to or deployed on the surface 200, a horizontal support member 118 which is coupled to or integrally formed with member 116, a crank assembly 120 which is operatively (e.g., movably) coupled to member 116, and, in one non-limiting embodiment of the invention, the containment portion 14 selectively and removably rests upon a "shoe" or storage/reception portion 122. The support members 116 and 118 may be formed of "one piece" or welded and/or otherwise joined at junction 114. In one non-limiting embodiment, a secondary support member 130 is added at a forty-five degree angle between support members 116, 118 in order to enhance the structural integrity of the combined members 116, 128. In the most preferred embodiment of the invention, the member 116 is may be selectively and removably deployed into a "stand" member 190 which is bolted and/or otherwise permanently coupled to the floor or other surface of a selectively movable assembly.

In one non-limiting embodiment of the invention, the "shoe" or storage portion 122 is deployed a short distance from the support member 116 and beneath the support member 118 upon surface 200. The storage portion 122 can be of substantially any configuration which is adapted to receive the containment portion 14. In one non-limiting embodiment of the invention, the storage portion 122 is comprised of a base member 150 which resides upon and is connected to the surface 200, and a support member 155 which is substantially "Y-shaped" in cross-section and which is coupled to the portion 150.

Further, a crank mechanism 120, as deployed on or within support member 16, includes a winch assembly 124 and a cable 126. The cable 126 is routed through the winch assembly 124 and through a ring or other routing member 140 deployed the bottom side 136 of support member 118. The cable 126 also includes a hook member 145 which is on the end of cable 126 which is remote from the winch assembly 124, and the hook member 145 is adapted to selectively and frictionally engage and be selectively received within the eye member 32. It should be realized that substantially any winch assembly can be used in the rescue assembly 10, including assemblies which are operated in a manual or an automatic fashion. It should be further realized that the support members be arranged in substantially any configuration which operatively allows the hoisting or lifting of the containment portion 14 from a first "stored" or non-operative position in which the containment portion 14 rests upon the support portion 122 to a second operative position in which the containment portion 14 is cooperatively supported by the support members 116, 118 and the crank mechanism 120. It should be realized that nothing in this description is meant to limit the present invention to a particular type of hoist or winch assembly. It should further be realized that, in the most preferred embodiment of the invention, the member 116 is selectively removable from the stand member 190, and therefore may be selectively stored and/or otherwise removed from the surface 200 when the assembly 10 is not in use.

Figure 4:
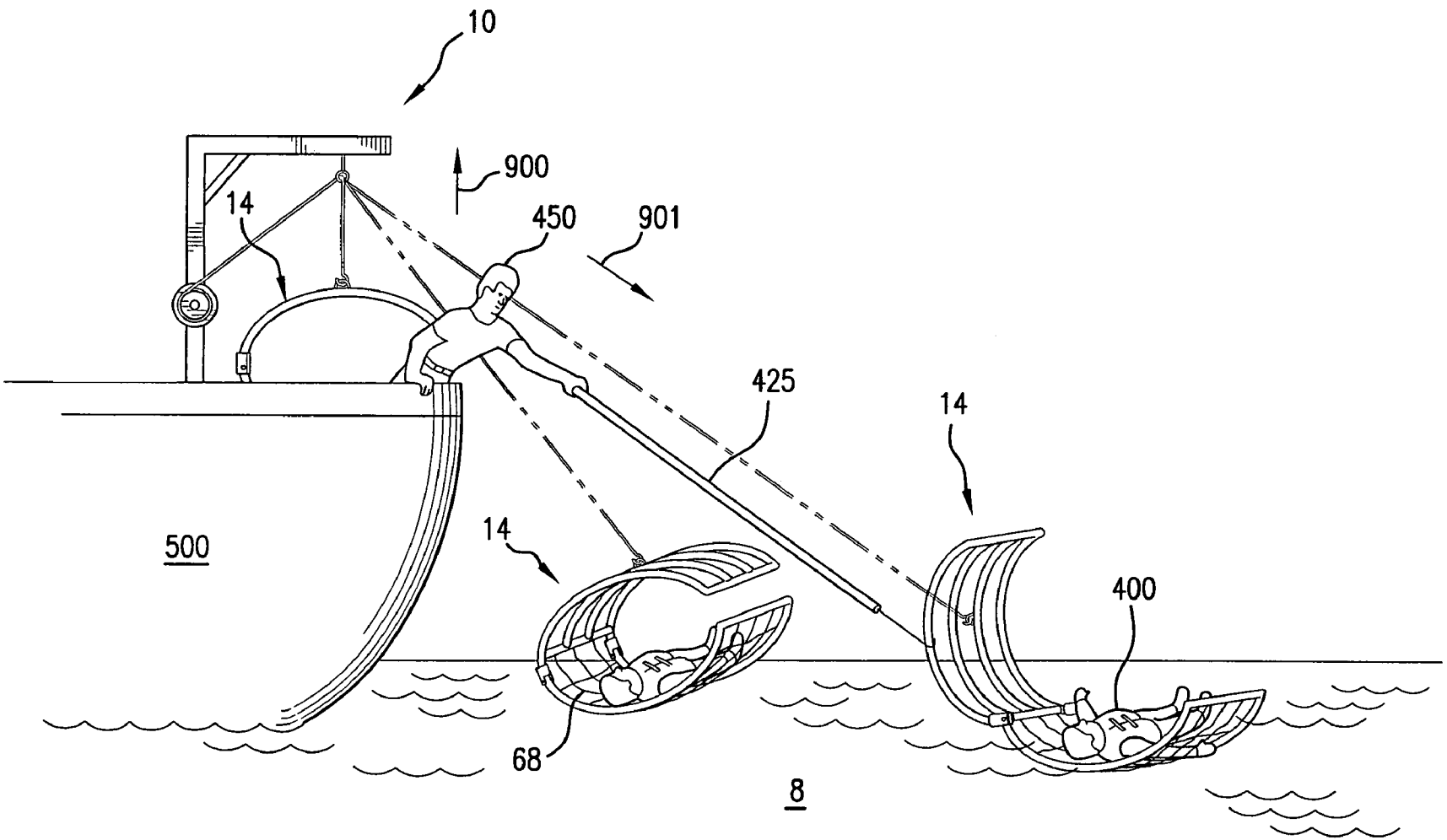
FIG. 4 is an environmental view of the rescue assembly which is shown in FIG. 1 used to rescue an individual within a marine-type environment.

In operation, as best shown in FIG. 4, when the rescue assembly is not in use, the rescue and/or "containment" portion 14 is in a first closed position, and rests upon the storage portion 122 (shown best in FIG. 1). When a rescue of an individual or item, such as individual 400) becomes necessary, the hook 145 of the cable 126 is selectively coupled to the eye member 32 of the containment portion 14, and the winch assembly 124 is activated in a first direction 900, effective to "reel in" a portion of the cable 126. When the cable 126 is "reeled in" in this manner, the hook member 145 exerts force in an upward direction (i.e., engages and lifts) the eye member 32 away from the surface 200, effective to raise and/or lift the containment portion 14 off of and/or away from the storage portion 122. The cable 126 is then "let out" by the activating the winch assembly 124 in a second, opposite direction 901, effective to selectively and forcibly lower the containment portion 14 to an operative area (e.g., off the deck of a ship 500 and into the water 8). It should be apparent that by the coupling of the hook member 145 and the eye member 32, the hoist assembly 10 is able to selectively exert or release force upon (i.e., lift/hoist or lower) the containment portion 14.

Once the portion 14 has been deployed into the water or marine environment 8, the containment portion 12 is selectively moved from the first closed position to the second operative and/or open position by manipulation by a boat hook or other type of manipulation implement 425 which is controlled by an individual 450. That is, the implement 425 forces portion 12 away from portion 16 after the implement 425 is selectively inserted into the cavity 300. Such pushing causes the ends 21 to move and/or pivot within the reception portion 25 and around pin 30 (in a direction which is perpendicular to direction 31), thereby allowing the portions 12, 16 to selectively separate. It should be apparent that this process may be selectively reversed, thereby resulting in the closing of the containment portion 14 and/or causing portions 12, 16 to selectively approach one another. The individual 450 may be resident within or upon the selectively movable assembly 500 in which the marine rescue assembly 10 is deployed, and/or may be resident within the water or marine environment 8. The hook and/or other implement 425 (e.g., a long stick) is used by a rescuer and/or other individual 450 to manipulate (e.g., push, pull, drag, and/or otherwise maneuver) the portion 16 beneath and/or around the individual and/or item to be rescued 400.

Once the portion 14 is deployed and/or selectively maneuvered into the desired position in the water or marine environment 8, the individual to be rescued 400 is "scooped up" (without requiring the individual 400 to do anything) by the pliable netting portion 68. The containment portion 14 is then selectively moved to the first closed position, by use of implement 425 (e.g., the portions 12, 16 are substantially closed). It should be realized that the netting portion 68 is effective to support the individual or item 400 within the cavity 300, substantially preventing and/or prohibiting movement of the containment portion 14 during the rescue operation due to wind and/or water conditions. Finally, the winch assembly 124 is again moved in direction 900, effective to "reel in" the cable 126 and cause the hook member 145 to engage and/or exert force upon the eye member 32, effective to lift, hoist, and/or otherwise remove the containment portion 14 from the water or marine environment 8, thereby rescuing the individual 400.

It should be apparent that the firm nature and/or composition of the generally round firm members 50, 51, 90, the stiffening ribs 40–43 and the end portions 85, 86, and the semi-cylindrical shape of the containment portion 14 allow the containment portion 14 to be drawn smoothly, efficiently and quickly through a body of water, effective to make it easy to position the containment portion 14 for a rescue. It should further be apparent that while the firm, cage-like structure previously described provides stability and reduces error during a rescue operation, the pliable netting portion 68 is specifically adapted to "scoop up" the individual to be rescued, and when an individual is thus "scooped" into the containment portion 14, the pliable netting portion is substantially deformed, thereby providing a soft and/or "cushy" portion on which the individual rests. Thus, the combined "firm portion" 12 with the substantially "pliable portion" 16 allows the containment portion 14 to be accurately deployed within the water 8 very close to the individual 400 to be rescued and that the selectively articulable nature of the containment portion 14 allows the individual 400 to be rescued in a safe and efficient manner.

It should be understood that the present invention is not limited to the exact construction or embodiment which is delineated above, but that various changes and modifications may be made without departing from the spirit and the scope of the inventions as are more fully delineated in the following claims.

What is claimed is:

1. A marine assembly comprising a semi-cylindrical containment portion having a first firm portion with a plurality of substantially identical stiffening ribs; and a second pliable net portion and wherein the first portion is selectively articulable with respect to the second portion.

2. The marine assembly of claim 1 wherein said semi-circular containment portion further comprises:

a first portion comprising first and second substantially identical and generally round firm members, which are in parallel relation to each other, and wherein said first portion further includes a first and second substantially identical and arcuate stiffening rib, each of said first and second ribs being connected to said first and second substantially identical and generally round firm members, and wherein said first portion further includes third and fourth substantially identical and arcuate stiffening ribs, and wherein each of said third and fourth stiffening ribs are coupled to and terminate within said first generally round firm member receive, along respective side portions, said second generally round firm member, and wherein each of said third and fourth stiffening ribs include respective and substantially identical flared ends having a respective connector reception portion; and a second portion comprising a third generally round and firm member which is substantially identical to and generally parallel to said first and second generally round firm members and which includes a pair of opposed end portions which are selectively and respectively received into a unique one of said reception portions, thereby allowing said second portion to be selectively articulable with respect to said first portion, and wherein said second portion includes a pliable net portion which is coupled to said second and third generally round firm members and said opposed end portions and wherein said first and second portions cooperatively form a cavity which is generally C-shaped in cross-section.

3. The marine assembly of claim 2 wherein said marine assembly further comprises:

A first vertical support member;

A second horizontal support member;

A winch assembly;

A cable; and

A storage support member.

4. The marine assembly of claim 3 wherein said hoist assembly is deployed on a surface of a selectively movable assembly.

5. The marine assembly of claim 2 wherein said second generally round firm member includes a hook member which is adapted to operatively and frictionally receive an eye member.

6. The marine assembly of claim 2 wherein said pliable net portion is weighted.

7. A marine assembly comprising a containment portion which comprises:

a first portion comprising first and second substantially identical and generally round firm members, which are in parallel relation to each other, and wherein said first portion further includes a first and second substantially identical and arcuate stiffening rib, each of said first and second ribs being connected to said first and second substantially identical and generally round firm members, and wherein said first portion further includes third and fourth substantially identical and arcuate stiffening ribs, and wherein each of said third and fourth stiffening ribs are coupled to and terminate within said first generally round firm member receive, along respective side portions, said second generally round firm member, and wherein each of said third and fourth stiffening ribs include respective and substantially identical flared ends having a respective connector reception portion; and a second portion comprising a third generally round and firm member which is substantially identical to and generally parallel to said first and second generally round firm members and which includes a pair of opposed end portions which are selectively and respectively received into a unique one of said reception portions, thereby allowing said second portion to be selectively articulable with respect to said first portion, and wherein said second portion includes a pliable net portion which is coupled to said second and third generally round firm members and said opposed end portions and wherein said first and second portions cooperatively form a cavity which is generally semi-cylindrical in cross-section.

8. The marine assembly of claim 7 further comprising a hoist portion comprising:

A first vertical support member;

A second horizontal support member;

A winch assembly;

A cable; and

A storage support member.

9. The marine assembly of claim 8 wherein said hoist assembly is deployed on a surface of a selectively movable assembly.

10. The marine assembly of claim 8 wherein said second generally round firm member includes a hook member which is adapted to operatively and functionally receive an eye member.

11. The marine assembly of claim 8 wherein said pliable net portion is weighted.

12. The marine rescue assembly of claim 7 further including a cable wherein said cable includes a hook member, said hook member being adapted to selectively, removably and frictionally engage an "eye" member.

13. The marine assembly of claim 12 further including a hoist assembly wherein said hoist assembly is operatively coupled to a containment portion, said containment portion comprising:

a first portion comprising first and second substantially identical and generally round firm members, which are in parallel relation to each other, and wherein said first portion further includes a first and second substantially identical and arcuate stiffening rib, each of said first and second ribs being connected to said first and second substantially identical and generally round firm members, and wherein said first portion further includes third and fourth substantially identical and arcuate stiffening ribs, and wherein each of said third and fourth stiffening ribs are coupled to and terminate within said first generally round firm member receive, along respective side portions, said second generally round firm member, and wherein each of said third and fourth stiffening ribs include respective and substantially identical flared ends having a respective connector reception portion; and a second portion comprising a third generally round and firm member which is substantially identical to and generally parallel to said first and second generally round firm members and which includes a pair of opposed end portions which are selectively and respectively received into a unique one of said reception portions, thereby allowing said second portion to be selectively articulable with respect to said first portion, and wherein said second portion includes a pliable net portion which is coupled to said second and third generally round firm members and said opposed end portions.

14. The marine assembly of claim 13 further including a cable wherein said cable includes an eye member which is adapted to operatively and frictionally engage a hook member.

15. The marine assembly of claim 14 further including a hoist assembly wherein said hoist assembly is deployed on a surface of a selectively movable assembly.

16. A method for rescuing an individual from a body of water, comprising the steps of:

(a) forming a marine assembly which includes a hoist assembly which is operatively coupled to a containment portion having a first firm portion which includes a plurality of substantially identical stiffening ribs, and a second pliable netting portion, and wherein said containment portion is selectively and articulably movable from a first closed position to a second open position by means of a maneuvering implement, and wherein said containment portion is generally semi-cylindrical;

(b) hoisting said containment portion from a storage position;

(c) articulating said containment portion from first closed position to said second open position by means of said maneuvering implement;

(d) deploying said containment portion into an operational area;

(e) articulating said containment portion to said first closed position, thereby "scooping up" and containing an individual; and (f) hoisting said containment portion from said operational area; thereby rescuing said contained individual from said operational area.

17. The method of claim 16 further comprising the step of forming a marine assembly which includes a hoist assembly which is operatively coupled to a containment portion having a first firm portion which includes a plurality of substantially identical stiffening ribs, and a second pliable netting portion, and wherein said containment portion is selectively and articulably movable from a first closed position to a second open position by means of a maneuvering implement, and wherein said containment portion is generally semi-cylindrical.

18. The method of claim 16 further comprising the step of deploying said marine assembly within a selectively movable assembly.

* * * * *